United States Patent [19]

Tohda et al.

[11] Patent Number: 4,634,934

[45] Date of Patent: Jan. 6, 1987

[54] ELECTROLUMINESCENT DISPLAY DEVICE

[75] Inventors: Takao Tohda, Ikoma; Tomizo Matsuoka, Neyagawa; Yosuke Fujita, Ashiya; Atsushi Abe, Ikoma; Tsuneharu Nitta, Katano, all of Japan

[73] Assignee: Matsushita Electric Industrial Co. Ltd., Kadoma, Japan

[21] Appl. No.: 572,415

[22] PCT Filed: May 18, 1983

[86] PCT No.: PCT/JP83/00146

§ 371 Date: Jan. 18, 1984

§ 102(e) Date: Jan. 18, 1984

[87] PCT Pub. No.: WO83/04123

PCT Pub. Date: Nov. 24, 1983

[30] Foreign Application Priority Data

May 19, 1982 [JP] Japan ..... 57-85138
Mar. 25, 1983 [JP] Japan ..... 58-50678

[51] Int. Cl.[4] ..... H05B 37/00

[52] U.S. Cl. ..... 315/169.3; 250/484.1; 313/503

[58] Field of Search ..... 383/503; 315/169.3; 250/484.1

[56] References Cited

U.S. PATENT DOCUMENTS

| | | | |
|---|---|---|---|
| 2,925,532 | 2/1960 | Larach | 313/503 |
| 3,133,222 | 5/1964 | Cerull'i | 313/503 |
| 3,564,260 | 2/1971 | Tanaka et al. | 315/169.3 |
| 3,590,253 | 6/1971 | Novice | 250/484.1 |
| 4,137,481 | 1/1979 | Hilsum | 313/503 |
| 4,486,499 | 12/1984 | Morimoto | 313/503 |

FOREIGN PATENT DOCUMENTS

| | | |
|---|---|---|
| 49-46692 | 5/1974 | Japan . |
| 50-2487 | 11/1975 | Japan . |
| 52-129296 | 10/1977 | Japan . |
| 53-118390 | 10/1978 | Japan . |
| 56-165296 | 12/1981 | Japan . |

OTHER PUBLICATIONS

Sasakura et al., "The Dependency of Electroluminescent Characteristics of ZnS:Mn Thin Films Upon Their Device Parameters", J. Appl. Phys., vol. 52, No. 11, Nov. 19, 1981.

Direct Current Thim Film Electroluminescence Device by Marrello et al., IBM Tech. Disc. Bull., vol. 22, No. 4, Sep. 79, p. 1636.

*Primary Examiner*—Harold Dixon

*Attorney, Agent, or Firm*—Spencer & Frank

[57] ABSTRACT

Electroluminescent display device suitable for ac and unipolar pulse voltage operation, and ensuring an increased luminescent brightness and a low driving voltage, comprises a transparent electrically insulating substrate; an electroluminescent layer comprised of zinc sulfide (ZnS) and at least one luminescingly active material; an electrically insulating layer formed on one surface of said electroluminescent layer; and first and second energizing means for applying signal voltages across said electroluminescent layer and said insulating layer corresponding to information to be displayed, wherein said first energizing means is interposed between said transparent substrate and said electroluminescent layer, and includes at least one semiconductive electrode which contacts said electroluminescent layer and is comprised of a semiconductive material containing at least one chemical compound selected from the group consisting of the chemical compounds of Groups II-VI, and wherein said second energizing means is arranged on said insulating layer on the surface thereof opposite said electroluminescent layer.

2 Claims, 8 Drawing Figures

EFFECT OF VOLTAGE REVERSAL

ELECTROLUMINESCENT DISPLAY DEVICE

TECHNICAL FIELD

The present invention relates to electroluminescent display devices and more particularly to an electroluminescent display device having a novel construction which ensures an improved luminescent brightness and low voltage driving.

BACKGROUND ART

In the past, electroluminescent display devices (hereinafter simply referred to as EL display devices) have been known including EL display devices of a double insulating layer type in which the sides of an electroluminescent light-emitting layer (hereinafter simply referred to as an EL layer) are held between insulating layers which are in turn held externally between a transparent electrode made essentially of indium oxide ($In_2O_3$) or tin oxide ($SnO_2$) and a metal electrode made of aluminium (Al) or the like and EL display devices of a single insulating layer type in which an EL layer is directly formed on a transparent electrode mass essentially of indium oxide or tin oxide and then an insulating layer and a metal electrode are successively provided on the EL layer. If these two types of EL display devices are constructed so that they have the same total insulating layer thickness and the same EL emitting thickness and an ac voltage or pulse voltage is applied to cause light emission, the EL display device of the single insulating layer type is lower than the EL display device of the double insulating layer type in terms of luminescent threshold voltage and also the EL display device of the double insulating layer type is higher than the EL display device of the single insulating layer type in terms of luminescent brightness. Thus, the known EL display devices have had their own merits and demerits and therefore there has been a demand for an EL display device which has a lower luminescence threshold voltage or is adapted to be driven at a lower voltage and which also has a higher luminescent brightness.

SUMMARY OF THE INVENTION

The present invention provides an EL display device of the type in which energizing means apply signal voltages corresponding to information to an assembly of an EL layer, including zinc sulfide containing a luminescently active material, and an insulating layer thereby displaying the information in the form of an image, wherein one of the energizing means arranged on the side of the EL layer includes a plurality of semiconductive electrodes containing at least one compound selected from the group consisting of the chemical compounds of Groups II–VI or at least one compound selected from the group of chemical compounds of Groups II–VI and tin oxide thus ensuring a reduced luminescent threshold voltage and an increased luminescent brightness.

As regards the Group II–VI chemical compound constituting the semiconductive electrodes which form one of the energizing means, at least one of zinc oxide (ZnO), zinc selenide (ZnSe), zinc telluride (ZnTe), zinc sulfide (ZnS), cadmium sulfide (CdS) and cadmium selenide (CdSe) is preferred and particularly zinc oxide is preferred most. Also, it is needless to say that the semiconductive electrodes may be made of at least one of these chemical compounds and tin oxide.

Any one of the heretofore known materials may be used as the luminescingly active material added to the zinc sulfide of the EL layer and it is only necessary to make the selection in accordance with the desired luminescent color. Manganese (Mn), copper (Cu), silver (Ag), aluminum (Al), terbium (Tb), dysprosium (Dy), erbium (Er), praseodymium (Pr), samarium (Sm), holmium (Ho), thulium (Tm) and their halides may be cited as examples of the luminescingly active material.

DESCRIPTION OF THE PREFERRED EMBODIMENTS

Figure 1:
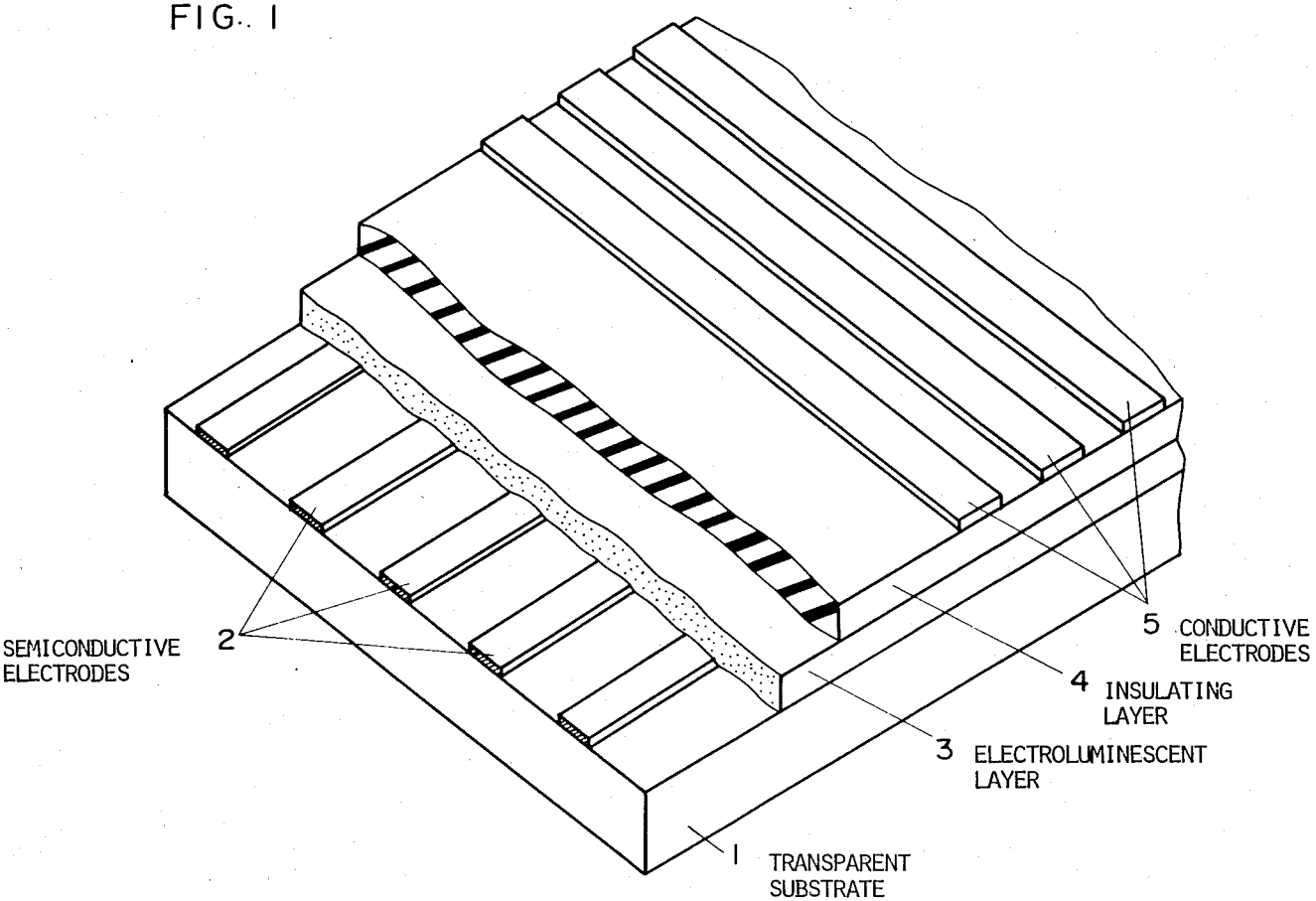
FIG. 1 is a partly cutaway perspective view showing an example of an EL display device according to the invention.

FIG. 1 shows one embodiment of an EL display device according to the invention. In this device, a plurality of semiconductive strip electrodes 2 are arranged in parallel on one surface of a transparent insulating substrate, e.g., a glass substrate 1. The semiconductive strip electrodes 2 are made of zinc oxide and have a thickness of 100 nm. An EL layer 3 and an insulating layer 4 are successively formed on one surface of the glass substrate 1 including the upper sides of the semiconductive strip electrodes. Formed on the insulating layer 4 are a plurality of strip electrodes 5 which are arranged parallel to each other and extend in a direction perpendicular to the direction of the semiconductive strip electrodes 2. The EL emitting layer 3 is made of zinc sulfide activated by manganese and it has a specific manganese content of 0.8 atomic % and a thickness of 0.5 μm. The insulating layer 4 is made of yttrium oxide ($Y_2O_3$) and it has a thickness of 0.4 μm. The strip electrodes 5 are made of aluminum.

The semiconductive strip electrodes 2 are formed by placing the glass substrate 1 in an argon gas of $2\times10^{-2}$ Torr, maintaining a temperature of 150° C., depositing zinc oxide on the glass substrate 1 at the rate of 10 nm per minute for 10 minutes by a radio-frequency sputtering process and then forming semiconductive strip electrodes by the widely used photolithography technique. The EL layer 3 is formed by maintaining the glass substrate 1 at 220° C., simultaneously evaporating zinc sulfide and manganese at the rate of 0.1 μm per minute for 5 minutes to attain a given ratio therebetween and then subjecting the same to a heat treatment at 550° C. for 2 hours in a vacuum. The insulating layer 4 is formed by the electron-beam evaporation of yttrium oxide and the electrodes 5 are formed by the vacuum evaporation of aluminum.

With this device, when an ac voltage or pulse voltage is applied selectively between the electrodes 2 and 5, the portion of the EL layer 3 enclosed by the selected electrodes emits light. This light is radiated to the outside mainly through the glass substrate 1. By successively applying signal voltages corresponding to information to be displayed, to the electrodes 2 and 5, it is possible to display the information as an image.

Figure 2:
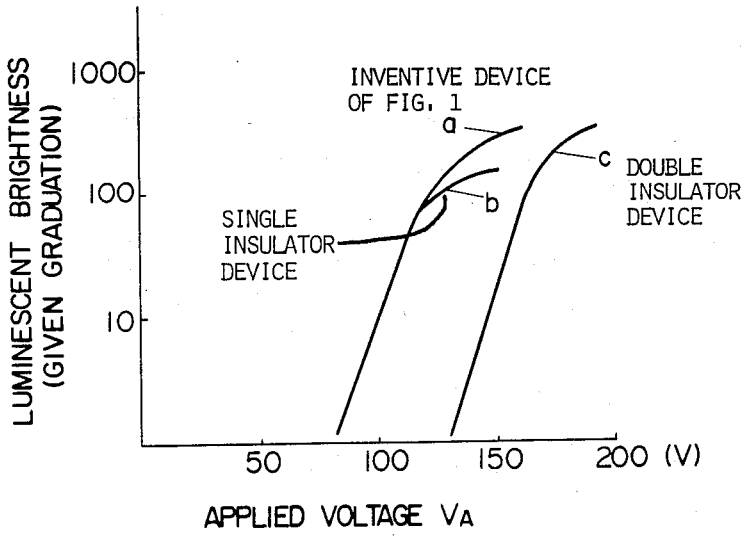
FIG. 2 is a graph showing applied voltage-luminescent brightness characteristic curves for the EL display device shown in FIG. 1 in comparison with the applied voltage-luminescent brightness characteristic curve of a conventional single insulating layer type EL display device and a double insulating layer type EL display device.
Figure 3:
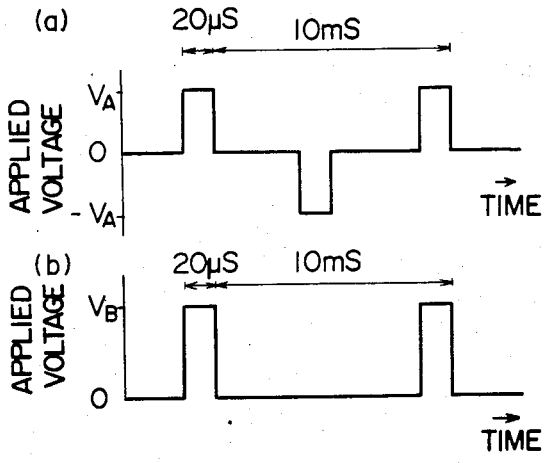
FIG. 3 shows the driving voltage waveforms of the EL display devices.

FIG. 2 compares the applied voltage ($V_A$)-luminescent brightness characteristics obtained by driving the device of FIG. 1 and the two conventional types of EL display devices with an ac pulse voltage ($V_A$) having a pulse width of 20 μsec and a period of 10 m sec as shown in (a) of FIG. 3. In FIG. 2, curve (a) shows the characteristic curve for an EL display device according to the invention and curve (b) shows the characteristic curve for a single insulating layer type EL display device constructed by replacing the semiconductive strip electrodes 2 with transparent electrodes made of tin-containing indium oxide in the device of the previously described construction. Also, curve (c) in FIG. 2 shows the characteristic curve for a conventional double insulating layer type EL display device constructed by successively forming an yttrium oxide layer of 0.2 μm thick, an EL layer made of manganese-activated zinc sulfide and having a thickness of 0.5 μm and an yttrium oxide layer having a thickness of 0.2 μm on transparent electrodes and finally forming aluminum electrodes. As will be seen from FIG. 2, the El display device of this invention is capable of reducing the drive voltage alone without reducing the luminescent brightness and making possible low-voltage operation of its drive circuit.

Figure 4:
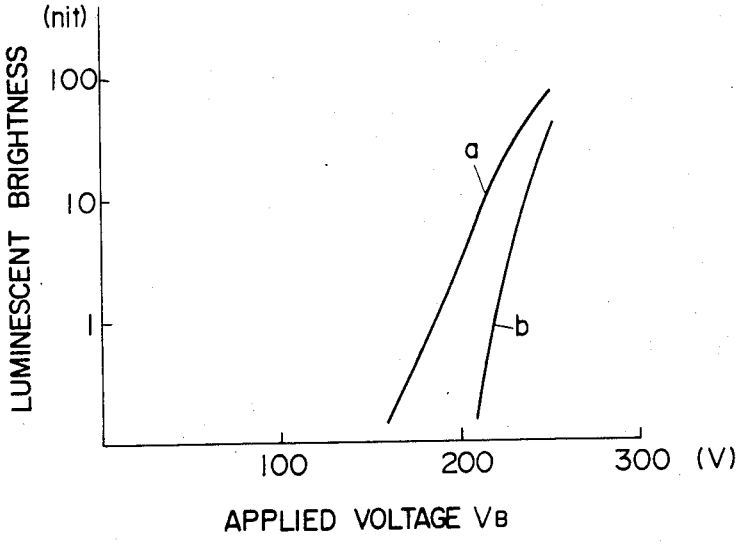
FIG. 4 is a graph showing the applied voltage-luminescent brightness characteristic curves obtained by driving the EL display device shown in FIG. 1 with dc pulse voltages.

FIG. 4 shows the applied voltage ($V_B$)-luminescent brightness characteristics obtained by applying a dc pulse voltage ($V_B$) having a pulse width of 20 μsec and a pulse spacing of 10 m sec as shown in (b) of FIG. 3 to the EL display device according to the invention, with the curve (a) showing the characteristic obtained by applying a voltage of a polarity such that the electrodes 5 become positive with respect to the semiconductive strip electrodes 2 and the curve (b) showing the characteristic obtained by applying a voltage of a polarity such that the semiconductive strip electrodes 2 become positive with respect to the electrodes 5. As will be seen from FIG. 4, the EL display device according to the invention could produce a display with the maximum brightness of 90 nits by using a dc pulse voltage having a duty cycle of 1/500 and such a polarity that the electrodes 5 become positive with respect to the semiconductive strip electrodes 2. The realization of such a high brightness is considered to be due to the fact that the contact between the semiconductive strip electrodes 2 made of zinc oxide and the EL layer 3 is excellent thus facilitating the injection of electrons from the semiconductive strip electrodes 2 into the EL layer 3.

While the foregoing example describes the case in which the semiconductive electrodes are made of zinc oxide, similar effects were obtained by using semiconductive electrodes made of zinc selenide, zinc telluride, zinc sulfide, cadmium sulfide or cadmium selenide, any one of these compounds and tin oxide, zinc oxide and tin oxide, or a combination of a plurality of these materials. It was confirmed that a semiconductive layer thickness of 30 nm or over showed good reproducibility and effectiveness. In addition to Mn, at least one element selected from the group consisting of Cu, Ag, Al, Tb, Dy, Er, Pr, Sm, Ho, Tm and their halides may be used as the luminescingly active material and in this way EL display devices of different luminescent colors were constructed.

Then, while, in the EL display device shown in FIG. 1, the semiconductor strips serve as one of the two electrodes, where an EL display device has a wide surface areas so that the resistance of the semiconductive strips become so large that it is no longer negligible, it is only necessary to use a conductive strip of a lower resistance along with each semiconductive strip.

Figure 5:
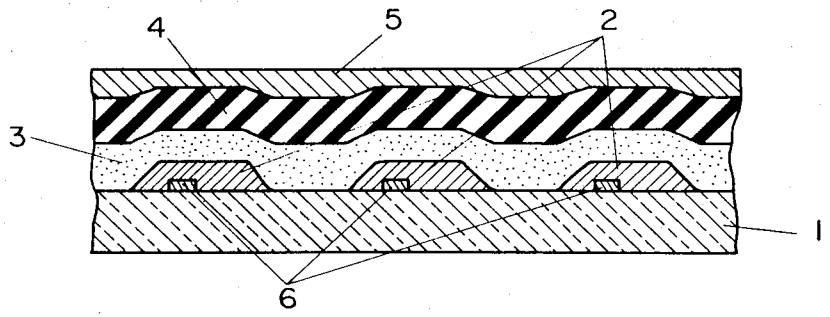
FIGS. 5, 6 and 7 are sectional views showing other examples of the EL display device according to the invention.

In other words, as shown in FIG. 5, conductive strips 6, having good conductivity and a very narrow width, as compared with the semiconductive strip electrodes 2 are disposed between each semiconductive strip electrodes 2 and the glass substrate 1, and thus the semiconductive electrodes include a semiconductive portion and a conductive portion provided by the semiconductive strip electrodes 2 and the conductive strips 6. The conductive strips 6 may, for example, be made of a material having a low specific resistance, such as titanium nitride, gold, platinum or molybdenum.

With this construction, the presence of conductive strips 6 has the effect of reducing the resistance of the electrode formed by the semiconductive strip electrodes 2, and the conductive strips 6 and make it possible to realize an EL display device having a large screen without any brightness inhomogeneity.

Figure 6:
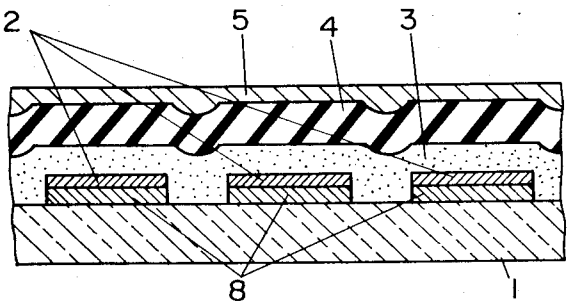

In the EL display device shown in FIG. 6, a transparent conductive strips 8 is placed between each semiconductive strip electrodes 2 and the glass substrate 1. With the electrode fomed by the semiconductive strip electrodes 2 and the transparent conductive strips 8, its electrical conductivity is provided mainly by the transparent conductive strips 8 and thus its resistance is reduced making it possible to realize an EL display device having a large screen.

Figure 7:
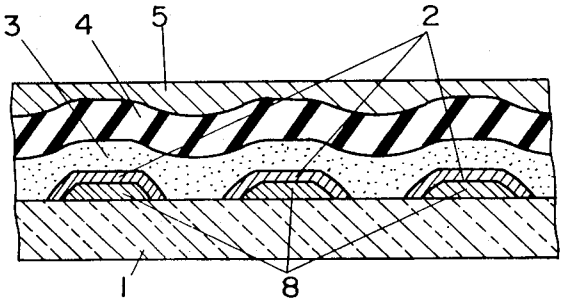

The EL display device shown in FIG. 7 is a partial modification of the construction of the device shown in FIG. 6. In this device each transparent conductive strip 8 is covered by each semiconductive strip electrode 2 and the two layers 2 and 8 are formed to have tapered edges.

Due to the fact that the semiconductive strip electrodes 2 cover the transparent conductive strips 8, the constituent elements of the transparent conductive strips 8 are prevented by the semiconductive strip electrodes 2 from diffusing into the EL layer 3 thus effectively preventing any deterioration in the characteristic of the EL layer 3 due to the constituent element of the transparent conductive strips 8. In other words, the transparent conductive strips 8 are generally made of oxides of indium and tin so that if the constituent element indium diffuses into the EL layer 3 whose principal constituent is zinc sulfide, this indium serves as a killer in the EL layer 3 and its luminescent characteristic is deteriorated. However, the diffusion of indium is prevented by the presence between the two layers 3 and 8 of the semiconductive strip electrodes 2 containing Groups compound of the II–VI.

Then, since each of the transparent conductive strips 8 and the semiconductive strip electrodes 2 has its two edges tapered, the deterioration due to any electric field concentration at the electrode edge portions is very effectively prevented as compared with the device shown in FIG. 6.

Figure 8:
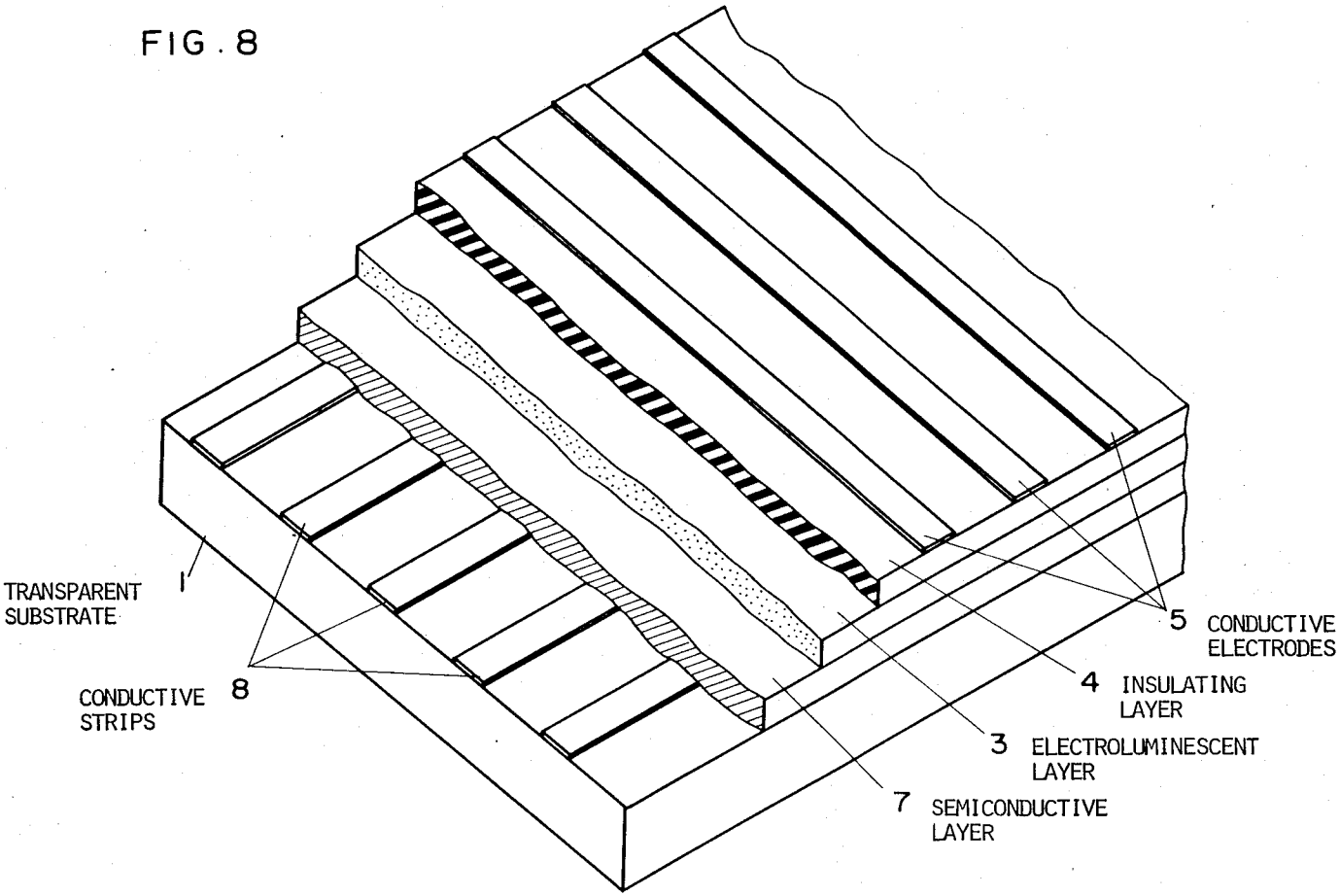
FIG. 8 is a partly cutaway perspective view showing still another example.

The EL display device shown in FIG. 8 is the EL display device of FIG. 6 in which the construction of the semiconductive electrodes is modified. In other words, this device replaces the semiconductive strips with a semiconductive layer 7 interposed between the glass substrate 1 and the transparent conductive strips 8 on one side and the EL layer 3. This device is advantageous in that the operation of selectively forming the semiconductive layer 7 is eliminated in the manufacture of the device and the device can be made easily. With this device, however, there is the danger of the semiconductive layer 7 causing cross-talk between the transparent conductive strips 8 and therefore the semiconductive layer 7 should preferably contain a material which increases the resistance value of the Group II–VI compound, e.g., lithium (Li), thereby satisfactorily increasing the resistance between the transparent conductive strips 8. In this case, the thickness of the semiconductive layer 7 is extremely thin as compared with the interval between the transparent conductive strips 8 and therefore any increase in the resistance value of the semiconductive layer 7 in its thickness direction due to the addition of the said material can be ignored.

INDUSTRIAL APPLICABILITY

As described hereinabove, the EL display device according to the invention includes semiconductive layers containing at least one compound selected from the group consisting of the compounds of the Group II–VI or the said compound and tin oxide and arranged on one surface of an EL layer thereby realizing an EL display device ensuring a reduced drive voltage and an increased brightness. Then, the fact that the use of a low drive voltage is sufficient makes it possible to use ICs of low withstand voltages for constructing a drive unit with ICs and thus the cost of the EL display device can be reduced. Further, this EL display device permits not only an ac voltage drive but also a dc pulse voltage drive and thus it has a remarkable utility value.

We claim:

1. An electroluminescent display device suitable for ac and unipolar pulse voltage operation, comprising:

a transparent electrically insulating substrate;

an electroluminescent layer comprised of zinc sulfide (ZnS) and at least one luminescingly active material;

an electrically insulating layer formed on one surface of said electroluminescent layer; and first and second energizing means for applying signal voltages across said electroluminescent layer and said insulating layer corresponding to information to be displayed, wherein said first energizing means is interposed between said transparent substrate and said electroluminescent layer, and includes a plurality of semiconductive electrodes which contact said electroluminescent layer and which are comprised of a semiconductive material containing at least one chemical compound selected from the group consisting of the chemical compounds of Groups II–VI, each of said plurality of semiconductive electrodes including a semiconductive portion and a conductive portion having a conductivity higher than that of said semiconductive portion, said semiconductive portion being interposed between said conductive portion and said electroluminescent layer, and being a plurality of semiconductive strips arranged in parallel to one another, and said conductive portion being a plurality of conductive strips arranged in parallel to one another, one conductive strip being provided for each of said semiconductive strips, and each of said semiconductive strips covering one of said conductive strips and having tapered edges so that the surface thereof which contacts said electroluminescent layer has a surface area which is smaller than the surface area of the surface thereof which contacts said transparent substrate and wherein said second energizing means is arranged on said insulating layer on the surface thereof opposite said electroluminescent layer.

2. An electroluminescent display device according to claim 1, wherein said plurality of conductive strips are a plurality of transparent conductive strips.

* * * * *